United States Patent [19]

Nelson, Jr.

[11] 4,262,804

[45] Apr. 21, 1981

[54] DISPLAY CONTAINER

[75] Inventor: Bennie C. Nelson, Jr., Romeoville, Ill.

[73] Assignee: Container Corporation of America, Chicago, Ill.

[21] Appl. No.: 48,978

[22] Filed: Jun. 15, 1979

[51] Int. Cl.[3] ..... B65D 1/34

[52] U.S. Cl. ..... 206/561; 206/564; 206/822; 229/30; 229/32; 229/27

[58] Field of Search ..... 206/564, 562, 561, 563, 206/822, 45.18; 229/30, 32, 31 R, 31 FS, 27, 23 A

[56] References Cited

U.S. PATENT DOCUMENTS

| | | | |
|---|---|---|---|
| 3,004,696 | 10/1961 | McCormick | 229/27 |
| 3,055,572 | 9/1962 | Crane | 229/27 |
| 3,233,726 | 2/1966 | Gero | 229/27 |
| 3,680,687 | 8/1972 | D'Alessio | 229/27 |
| 3,747,831 | 7/1973 | Hanson | 229/27 |
| 3,804,321 | 4/1974 | Forbes, Jr. | 229/27 |
| 4,034,908 | 7/1977 | Forbes, Jr. et al. | 229/31 FS |
| 4,111,299 | 9/1978 | Taub | 206/564 |
| 4,199,059 | 4/1980 | Maroszek | 206/45.18 |

*Primary Examiner*—Joseph Man-Fu Moy
*Attorney, Agent, or Firm*—Richard W. Carpenter

[57] ABSTRACT

A generally L-shaped tray type display container formed from a unitary blank of foldable paperboard which is designed to display different type of books and binders at different angles to afford views of various sides and ends of the articles displayed.

4 Claims, 4 Drawing Figures

DISPLAY CONTAINER

SUMMARY OF THE INVENTION

This invention relates to display containers and more particularly to a container formed from a unitary blank of foldable paperboard which is designed to display different types of books, binders, and the like, at different angles to afford views of various sides and ends of the articles displayed.

It is an object of the invention to provide, in a display container of the type described, a unique configuration which includes a corner post providing interior walls, which together with the exterior walls provide a generally L-shaped tray for holding articles to be displayed.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
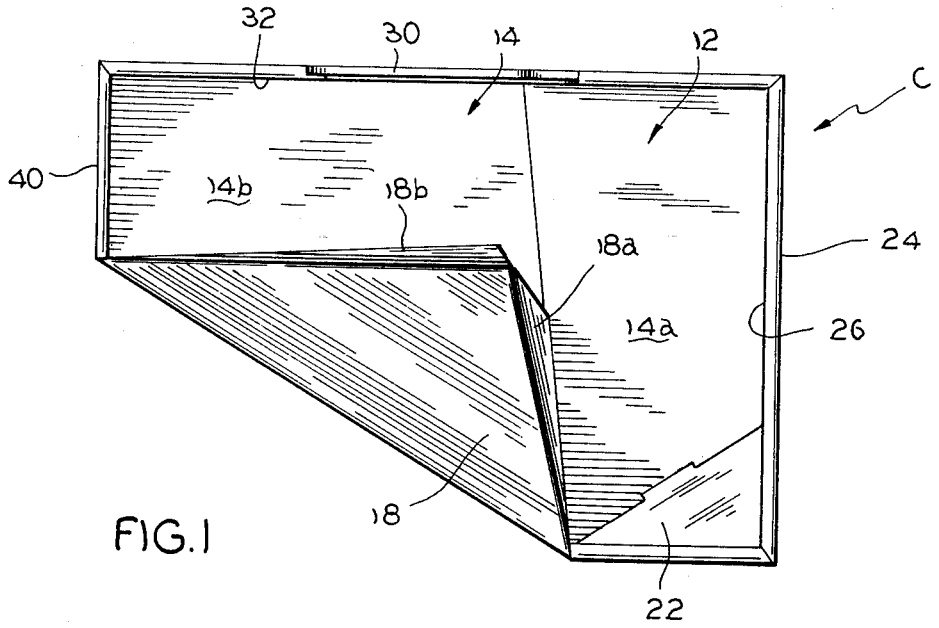
FIG. 1 is a top plan view of a container embodying features of the invention, as shown in the erected condition.
Figure 2:
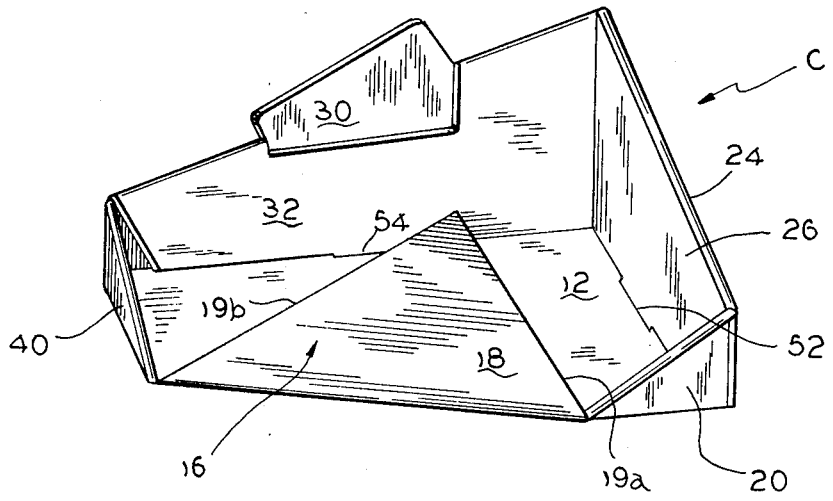
FIG. 2 is a perspective view of the structure illustrated in FIG. 1.
Figure 4:
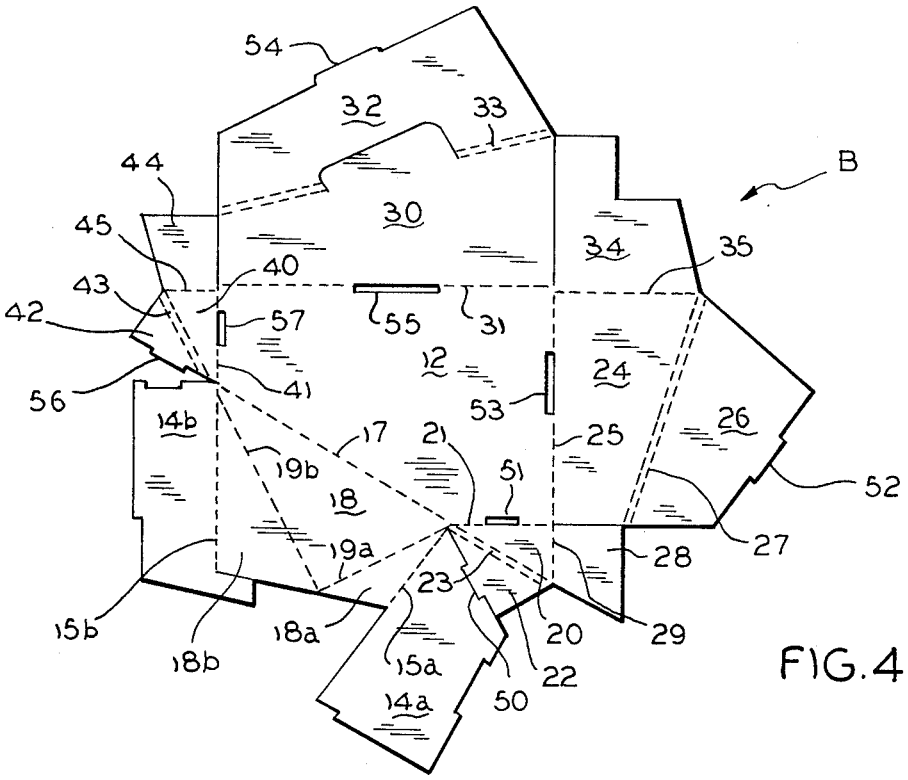
FIG. 4 is a plan view of a blank of sheet material from which the container illustrated in the other views may be formed.

Referring now to the drawings for a better understanding of the invention, it will be seen that the novel tray top display container indicated generally at C, embodying features of the invention, may be formed from unitary blank B of foldable sheet material as shown in FIG. 4.

The purpose of the invention is to provide a generally L-shaped container so as to permit the display of articles such as books disposed in different vertical planes to afford a view of the various surfaces of the articles displayed. This has been accomplished in the present invention by providing a unique corner post arrangement which affords interior walls in a manner hereinafter described.

Figure 3:
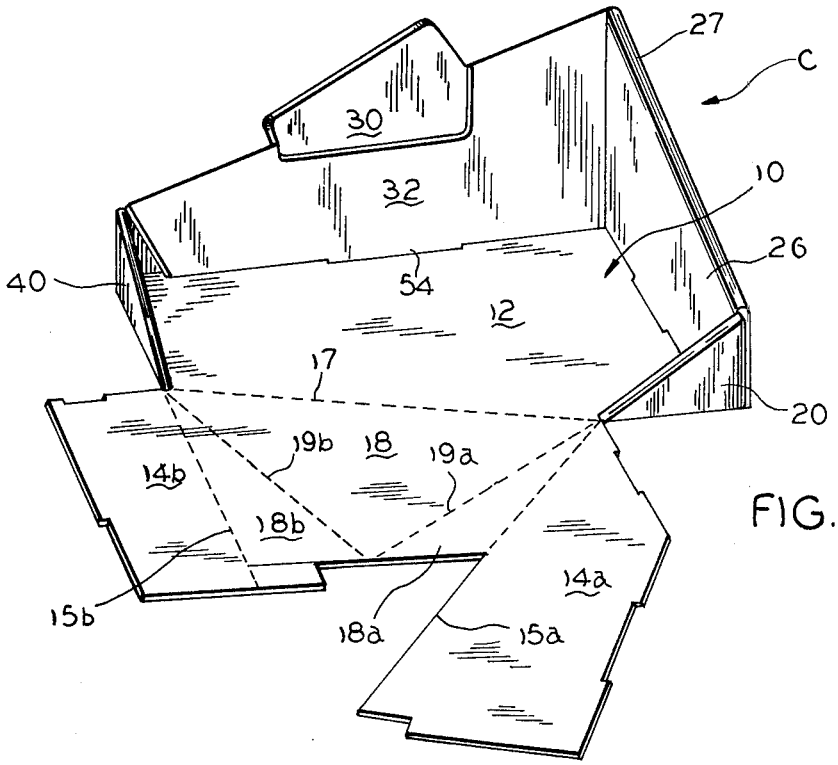
FIG. 3 is a view similar to FIG. 2 but with portions of the structure not yet in fully assembled condition.

As best seen in FIGS. 3 and 4, container C includes a pentagonally shaped bottom wall 10 having a one piece lower or outer panel 12 and an upper or inner panel 14 comprised of a pair of co-planar panel sections 14*a* a and 14*b*.

As previously mentioned, in order to afford interior walls, there is provided a corner post member indicated generally at 16 which comprises a generally triangular outer panel 18 foldably joined at its lower edge along fold line 17 to an edge of bottom wall outer panel 12, and a pair of generally triangular shaped inner vertical walls 18*a* and 18*b* which are foldably joined at their upper edges to adjacent upper edges of outer panel 18 along fold lines 19*a* and 19*b*, respectively. It will be seen that outer wall 18 of the corner post member 16 slopes inwardly and upwardly; whereas the other walls of the container are all disposed in generally vertical planes as hereinafter described.

It will be noted that bottom wall inner panel sections 14*a* and 14b are foldably joined to the lower edges of corner post inner walls 18*a* and 18*b*, respectively, along fold lines 15*a* and 15*b*, respectively, and are disposed to extend outwardly therefrom at substantially right angles thereto so as to overlie bottom wall outer panel 12.

Still referring to FIGS. 3 and 4 and moving counterclockwise around the container from the corner post member 16, it will be seen that four other side walls are provided which extend upwardly from other outer edges of bottom wall to provide a generally L-shaped recess in the container.

Still referring to FIGS. 3 and 4, it will be seen that the first side wall includes a pair of outer and inner panels 20 and 22, respectively, with outer panel 20 being foldably joined at its lower edge along fold line 21 to bottom wall outer panel 12 and being foldably joined at its upper edge along fold line 23 to an upper edge of outer panel 22. Panels 20 and 22 are folded together in face-to-face relation.

The second side wall includes a pair of outer and inner panels 24 and 26, respectively, with outer panel 24 being foldably joined at its lower edge along fold line 25 to bottom wall outer panel 12 and being foldably joined at its upper edge along fold line 27 to the upper edge of inner panel 26. Panels 24 and 26 are folded together in face-to-face relation, and have sandwiched therebetween a corner flap 28 which is foldably joined along fold line 29 to an adjacent edge of first side wall outer panel 20.

The third side wall includes a pair of outer and inner panels 30 and 32, respectively, with panel 30 being foldably joined at its lower edge along fold line 31 to bottom wall outer panel 12 and being joined at its upper edge along fold line 33 to inner panel 32. Panels 30 and 32 are folded in face-to-face relation and have sandwiched therebetween corner flap 34 which is foldably joined along fold line 35 to adjacent edge of second side wall outer panel 24.

The fourth side wall includes a pair of outer and inner panels 40 and 42, respectively, with panel 40 being foldably joined at its lower edge along fold line 41 to bottom wall outer panel 12 and foldably joined at its upper edge along fold line 43 to outer panel 42. In order to secure the third and fourth side walls to each other, there is provided a corner flap 44 which is foldably joined along fold line 45 to one edge of fourth side wall outer panel 40 and which is folded at right angles thereto and sandwiched between outer and inner panels 30 and 32 of the third side wall.

It will be noted that the inner side wall panels 22, 26, 32 and 42 are provided with downwardly projecting Walker lock type tabs 50, 52, 54 and 56 which are received within slots 51, 53, 55 and 57, respectively, in bottom wall outer panel 12 to maintain the container in assembled condition.

Although in the preferred embodiment illustrated in the drawings and described above, the container is pentagonal in shape with one corner post member and four side walls, the novelty in the invention resides in the provision of at least one corner post member.

Thus, without departing from the spirit or scope of the invention, if desired, the number of side walls may be increased or decreased, and additional corner post members may be included.

I claim:

1. A tray-type display container, formed of a unitary blank of foldable sheet material such as paperboard, for holding a plurality of articles such as books and binders in various positions to afford views of such articles from various angles, comprising:

(a) a bottom wall;

(b) a corner post member of generally triangular shape upstanding from said bottom wall and projecting into said container to present a pair of generally vertical interior walls disposed in intersecting planes;

(c) a plurality of vertically disposed side walls upstanding from said bottom wall and being foldably joined to each other, two of said side walls being disposed substantially perpenticular to each other and spaced apart from said pair of interior walls to form therebetween with said bottom wall a substantially L-shaped interior area for holding and displaying articles which are disposed in variour vertical planes.

2. A container according to claim 1, wherein said bottom wall is pentagonal.

3. A container according to claim 1, wherein said bottom wall is two-ply and includes a single lower panel and a pair of co-planar upper panels.

4. A container, according to claim 1, wherein said corner post member includes a sloping, outer, upper, side wall and a pair of generally vertical interior walls depending from inner edges of said upper side wall.

* * * * *